US005376190A

United States Patent [19]

Hoveling

[11] Patent Number: 5,376,190

[45] Date of Patent: Dec. 27, 1994

[54] METHOD FOR PRODUCING A GREEN PROTECTIVE COATING ON COPPER

[75] Inventor: Stefan Hoveling, Osnabrück, Germany

[73] Assignee: KM-Kabelmetal AG, Onsnabrück, Germany

[21] Appl. No.: 894,104

[22] Filed: Jun. 5, 1992

[51] Int. Cl.[5] ..... C23C 22/48

[52] U.S. Cl. ..... 148/269; 148/270; 148/272; 148/277; 148/282; 148/284

[58] Field of Search ..... 148/269, 270, 272, 277, 148/282, 284

[56] References Cited

U.S. PATENT DOCUMENTS 1,951,304 3/1934 Freeman, Jr. et al. ..... 148/272

3,497,401 2/1970 Hanson et al. ..... 148/269

FOREIGN PATENT DOCUMENTS 56-013483 2/1981 Japan ..... 148/269

*Primary Examiner*—Richard O. Dean
*Assistant Examiner*—Robert R. Koehler
*Attorney, Agent, or Firm*—Kenyon & Kenyon

[57] ABSTRACT

A method for forming a protective layer on a copper surface is set forth. The surface of degreased strips or sheets of copper are roughened by mechanical treatment in a controlled manner. The roughened surfaces of the strips or sheets are then chemically treated to bring about a green patination. After the chemical treatment, the strips or sheets are stored in a climate-controlled space.

11 Claims, No Drawings

METHOD FOR PRODUCING A GREEN PROTECTIVE COATING ON COPPER

BACKGROUND OF THE INVENTION

The invention relates generally to a method for providing a protective coating, similar to natural green-colored patina, on rolled strips or sheets made of copper such as are used for roof coverings and facade facings. More particularly, the method relates to a method that can be practice on an industrial scale.

Under normal atmospheric influences, copper will form a green to turquoise-colored coating or protective layer (the so-called patina) only after a relative long period of time, and even then only under certain conditions. The speed of formation of this natural patina is dependent, for example, on the following parameters:

Composition of the atmosphere (humidity, contaminant content);

Stress caused by solid particles (sand, dust);

Ambient temperature;

Incline of the surface of the copper components; and

Position of the copper surface relative to the direction of the wind and weather to which it is exposed.

In "Chemische Färbung von Kupfer und Kupferlegierungen" ("Chemical Coloration of Copper and Copper Alloys" published by the German Copper Institute), the following times are given for the formation of a natural patina under various atmospheric influences:

In ocean air: after about 6 years;

In a big city industrial atmosphere: after about 5 to 8 years; and

In a normal city atmosphere: after about 8 to 12 years.

The patina effectively protects the copper component against the further corrosive effect of weathering, so that the erosion rate of the copper becomes negligible for the highest basicity of the patina. Consequently, researchers became interested in imitating this protective layer at an early point in time. For example, the artificial green patination of copper objects, such as of statues and vessels by means of the stippling technique, has been known for a long time.

A number of patination solutions capable of inducing the desired reaction have also been applied to copper elements having broad surface areas, such as roof coverings. These larger elements have generally been treated in several working steps using spraying or brushing techniques. It is also known to pre-treat individual sheets of copper with a patination solution prior to their use as roof coverings.

The disadvantage of these methods is that either they require an excessive amount of time-consuming manual labor, or they are applicable only for limited areas, and therefore are not economical for industrial-scale production.

Finally, a method is also known in which patina-colored plastic layers are applied to copper strips intended for roof coverings and facade facings. A disadvantage of this method is that the layers applied can easily splinter off. Because the natural self-healing mechanism of the natural patina is absent, the underlying copper surface begins to degrade as soon as the layer begins to splinter off. Furthermore, the processing techniques required by this method, such as welding or edging, can only be carried out within certain restrictions.

This invention is directed to the problem of further developing a method for providing copper surfaces with a green, securely adhering cover layer that is very similar to natural patina, and which can be produced on the surfaces of semi-finished products made of copper on an industrial scale.

SUMMARY OF THE INVENTION

The invention solves this problem by mechanically roughening degreased copper and then subjecting it to a chemical treatment. The mechanical roughening may be carried out by a grinding or brushing process; the chemical treatment involves the use of a metal salt, e.g. ammonium chloride, metal chloride, sulfates, or nitrates. In particular, an aqueous solution composed of 50 to 250 g/l ammonium chloride and 100 to 250 g/l ammonium carbonate may be used.

The advantages of the method of this invention is that it can be practiced on a mass, continuous scale of production, which in turn provides the following benefits:

An extremely uniform pre-treatment of all strips and sheets of copper is achieved. This is an important prerequisite for providing artificial green patination of a uniform color;

Variable production lengths are possible without creating scrap;

No color changes occur at the ends of the strips or sheets;

No failures of the grinding belt occur, due to ends of strips or sheets projecting upwards; and Targeted control, for example of the grinding belt, is possible by regulation of the strip center or strip edges.

The protective layers on the green-patinated strips or sheets of copper produced according to the invention have excellent adhesive strength with respect to the underlying metal. Also, finger marks, which are frequently unavoidable in the installation of roof coverings and facade facings, are essentially unnoticeable on the resulting green-patinated surface.

As a further benefit, the protective cover layer supplied by this method also serves as a catalyst for the gradual formation of a natural patina—atmospheric influences cause the artificial protective layer to turn into a natural patina over time. The protective cover layer preferably is made of copper oxide ($Cu_2O$) and an essentially copper-free metal salt. The surface weight of the completely reacted protective layer is 180 to 680 mg/dm$^2$ after it has been stored in a climate-controlled setting, with the range of 330 to 525 mg/dm$^2$ being preferred.

DETAILED DESCRIPTION

The invention shall be further described by reference to the following example:

A cold-rolled strip of SF copper pursuant to DIN 1787, with a thickness of 0.7 mm, and a width of 1000 mm, is first degreased in a continuously operated apparatus. Immediately following degreasing, the copper strip is run through a belt grinder, having one or more grinding belts with a grain of 40 to 60, (an additional brushing device may also be used, if necessary), in order to increase its surface area in a targeted manner such as by altering it by a factor lying in the range of 1.1 to 5, e.g. 2. The installed strip center or strip edge regulation ensures precise positioning of the copper strip relative to the grinding belt. The copper strip then passes through a conventional duo-roller stand, the rollers of which preferably have surfaces that are roughened or textured in the direction of the roller axis. The copper strip may be provided in a form such as a roll that can be pulled as a strip from a conventional take-off device, transported past a station where it is exposed to the mechanical roughening effects of a pressure adjustable grinding belt or brush, and then wound up onto a take-up device. The copper strip is then passed through a conventional spraying and squeegee device, in which a chemical reagent for green patination is uniformly applied to the surface. After application of the reagent solution or after the mechanical roughening treatment, the copper strip is continuously divided laterally into finished lengths, as per customer requirements, using a concurrent lateral shears. The copper strips or sheets, coated on one side, are then placed individually onto frames, which are stored in a climate-controlled space for between 6 and 48 hours at a temperature of between 15° C. and 35° C., e.g., 20° C. and a relative humidity of between 70 and 100%, e.g., 70%. In order to accelerate formation of the protective layer on the copper in this climate-controlled space, an electrical voltage can be applied to the copper. Alternatively, a gaseous reaction medium can be introduced alone or in conjunction with the voltage. The gaseous medium can be oxygen gas or a sulfur-containing gas. After storage, the surface weight of the protective and cover layer of several sample pieces was determined, amounting to an average of about 430 mg/dm$^2$.

Following treatment, those bending and edging operations necessary for utilizing the components in construction area can be carried out on the artificially green-patinated copper strip without any damage or large-scale loosening of the protective cover layer.

What is claimed is:

1. A method for producing a green protective coating on rolled strips or sheets made of copper, comprising:

continuously degreasing the copper; increasing the surface area of the degreased copper by a factor of 1.1 to 5 by a continuously operating mechanical roughening means;

treating the copper with a chemical reagent to bring about the formation of a green patination, in a continuous operation; and storing the chemically treated copper in a climate-controlled space, wherein the surface weight of the coating so produced is between 180 mg/dm$^2$ and 680 mg/dm$^2$.

2. The method according to claim 1, wherein the surface weight of the layer is between 330 and 525 mg/dm$^2$.

3. The method according to claim 1, wherein the chemically treated copper is stored in the climate controlled space for between 6 and 48 hours.

4. The method according to claim 1, wherein the mechanical treatment is carried out continuously by grinding, brushing, or rough rolling the copper.

5. The method according to claim 1, wherein the copper strip is pulled from a take-off device to a take-up device, with a defined pressure being adjusted between the copper strip and the grinding belt and/or the brushes.

6. The method according to one of claim 1, wherein the coating comprises copper oxide and an essentially copper-free metal salt.

7. The method according to claim 1, wherein the chemically treated copper is stored at a temperature in the range between 15° and 35° C. and a humidity of between 70 and 100%.

8. The method according to claim 1, wherein the formation of the protective layer during the storage of the chemically treated copper is accelerated by the addition of gaseous reagents.

9. The method according to claim 8, wherein the gaseous reagent is oxygen gas.

10. The method according to claim 8, wherein the gaseous reagent is a sulfurous gas.

11. The method according to claim 1, wherein the copper strip is continuously divided laterally into the desired lengths, either after the mechanical treatment step or after application of the reaction solution.

* * * * *